US005957187A

United States Patent [19]

Gruben et al.

[11] Patent Number: 5,957,187

[45] **Date of Patent: *Sep. 28, 1999**

[54] RELEASEABLE ASSEMBLY FOR A DOOR

[75] Inventors: Wayne E. Gruben, Dubuque, Iowa; Peter S. Schulte, East Dubuque, Ill.; James P. Schwingle, Dickeyville, Wis.

[73] Assignee: Rite-Hite Holding Corporation, Milwaukee, Wis.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/690,261

[22] Filed: Jul. 24, 1996

Related U.S. Application Data

[63] Continuation-in-part of application No. 08/386,436, Feb. 10, 1995, Pat. No. 5,638,883.

[51] Int. Cl.[6] ..... A47H 3/00

[52] U.S. Cl. ..... 160/267.1; 160/271

[58] Field of Search ..... 160/268.1, 273.1, 160/264, 265, 271, 272, 270, 322, 267.1, 274

[56] References Cited

U.S. PATENT DOCUMENTS

| | | | |
|---|---|---|---|
| 3,878,879 | 4/1975 | Manna . | |
| 4,016,920 | 4/1977 | Shepard . | |
| 4,478,268 | 10/1984 | Palmer . | |
| 4,601,320 | 7/1986 | Taylor . | |
| 4,884,617 | 12/1989 | Coenraets . | |
| 5,025,847 | 6/1991 | Mueller . | |
| 5,056,579 | 10/1991 | Krafutler . | |
| 5,139,074 | 8/1992 | Warner . | |
| 5,139,075 | 8/1992 | Desrochers . | |
| 5,141,043 | 8/1992 | Kraeutler | 160/264 |
| 5,141,044 | 8/1992 | Hying et al. . | |
| 5,176,194 | 1/1993 | Chigusa | 160/272 X |
| 5,207,256 | 5/1993 | Kraeutler | 160/84.1 |
| 5,222,541 | 6/1993 | Hornberger . | |

(List continued on next page.)

FOREIGN PATENT DOCUMENTS

| | | |
|---|---|---|
| 125217 | 11/1984 | European Pat. Off. . |
| 1009862 | 6/1952 | France . |
| 240349 | 10/1925 | United Kingdom . |
| 1444017 | 4/1976 | United Kingdom . |

OTHER PUBLICATIONS

"Re–Coil Away Specifications"; M & I Door Systems Limited; Date unknown; 2 pages.

"'Re–Coil Away' Door System Installation Instructions"; M & I Door Systems, Ltd.; May 1991; 18 pages.

"M & I Door Systems Limited" Product Brochure; M & I Door Systems Limited; Date unknown; 4 pages.

"Rytec Breaks Away" Products Brochures; Rytec Corporation; 1992; 2 pages.

"Rapid Roll Doors: The Super–Fast Solution!" Products Brochure; Albany International; 1990; 8 pages.

"Marathon Spirit" Products Brochure; Marathon Door Division—ASI Technologies; 1991; 3 pages.

(List continued on next page.)

*Primary Examiner*—Blair M. Johnson

[57] ABSTRACT

An omni-directional breakaway guide assembly for use in conjunction with an edge member in an industrial door. The guide assembly comprises a guide extension for engaging guide members to guide the door in a plane, and an edge member portion coupled to the edge member. The breakaway guide assembly includes a releasable coupling between the guide extension and the edge member portion. Upon application of a sufficient force on the edge member at least one of the edge member portion and the guide extension portion deforms to allow the edge member portion to breakaway from the guide extension portion. Such breakaway may occur for forces applied in a variety of directions to the edge member.

8 Claims, 7 Drawing Sheets

U.S. PATENT DOCUMENTS

| | | | |
|---|---|---|---|
| 5,271,448 | 12/1993 | Delgado . | |
| 5,299,617 | 4/1994 | Hying et al. . | |
| 5,353,859 | 10/1994 | Oltahfer et al. . | |
| 5,477,902 | 12/1995 | Kraeutler | 160/84.06 |
| 5,526,865 | 6/1996 | Coenraets . | |
| 5,535,805 | 7/1996 | Kellogg et al. | 160/201 |
| 5,579,820 | 12/1996 | LePage et al. | 160/268.1 |
| 5,601,133 | 2/1997 | Krupke et al. | 160/271 X |
| 5,638,883 | 6/1997 | Schulte . | |
| 5,743,317 | 4/1998 | Beringer et al. | 160/274 |

OTHER PUBLICATIONS

"RT Series" Product Brochure; Kelley Company, Inc. 1993; 2 pages.

"Kelley Door Selection Guide"; Kelley Company, Inc.; 1993; 16 pages.

"Speedor" Product Brochure; Hart; Date unknown; 2 pages.

Albany International Competitor Data Sheet; Oct. 1989; 2 pages.

RELEASEABLE ASSEMBLY FOR A DOOR

CROSS-REFERENCE TO RELATED APPLICATIONS

This application is a continuation in-part of application U.S. Ser. No. 08/386,436, filed Feb. 10, 1995, now U.S. Pat. No. 5,638,883.

FIELD OF THE INVENTION

The invention relates generally to industrial roll-up doors, and more particularly to an improved, breakaway side guide extension mechanism for a roll-up door.

BACKGROUND OF THE INVENTION

Roll-up doors are used in a variety of industrial applications, typically for the purpose of separating areas within a building, or closing off building entries from the outside. A typical roll-up door comprises a fabric curtain which is wound about a roller joumalled for rotation above the doorway with which the roll-up door is associated. To close the door, the roller is rotated such that the curtain pays off of the roller to enclose the doorway. Of course, the door is opened by reversing the direction of the roller and rolling the fabric curtain onto the roller. Such roller doors are typically either powered opened and closed, or are powered open and allowed to fall closed by gravity.

When the roll-up door is placed over an exterior doorway of a building, provision must be made to prevent the fabric curtain from billowing due to wind being applied from the outside. Similarly, when the roll-up door is in place between different sections of a warehouse, there may be pressure differentials between these two sections, which may also cause billowing of the roll-up door if the door does not have provision to prevent this from happening. Such billowing is problematic because it affects door function and may allow leakage past the door. To correct for this problem, roll-up doors typically include a rigid or semi-rigid member along the leading edge thereof. For vertically operated doors, this leading edge member is in the form of a bottom bar to provide so-called "wind retention" or prevention of undesirable billowing. The bottom bar typically extends across the leading width of the door, and also includes extensions which extend past either side of the door. These extensions are typically received within side frames disposed on either side of the door and which run vertically along the side of the doorway for vertically operated doors. As the door moves between its open and closed positions, the bottom bar and its extensions or "side frame inserts" move within a generally vertical plane since they are guided within the generally vertical side frames which may include a guide track for that purpose. With the leading edge of the door thus restrained within a vertical plane, movement of the fabric curtain of the door out of that vertical plane is largely avoided. However, the bottom bar only ensures that the leading edge of the door stays in the vertical plane, and strong gusts of wind or large pressure differentials between sections of a building may still allow the remainder of the curtain to billow either during the curtain's travel, or when it is fully closed.

To prevent this undesirable movement of the door, many prior art doors use a tensioning means to place a vertically disposed tension on the door to prevent it from billowing out of the vertical plane. One example of such a tensioning means is a heavy bottom bar. The weight of the heavy bottom bar may provide sufficient vertical tension to prevent undesirable billowing particularly in a gravity-fall type door. Alternatively, external means may be used to provide the necessary tension. For example, belting is often used for this purpose. Typically, one end of the belting is attached to a roller pulley, and is wound and unwound from the roller in the opposite sense from the curtain. The belt is then passed through a pulley mounted near the bottom of the side frame. The other end of the belt is then attached to the side from insert of the bottom bar. As the belt is wound and unwound from the roller in an opposite sense to the curtain, it exerts a downward pulling force on the bottom bar and the side frame inserts thus placing the necessary vertical tension on the door. This pulling force may be enhanced by a torsion spring disposed in the roller and engaging the roller pulley as in U.S. Pat. No. 4,887,660 which is assigned to the Assignee of the present invention. Forces may also be applied directly to the belt as in U.S. Pat. No. 4,997,022. Other particular arrangements for the belting besides those previously described are also used to achieve the same purpose.

A further exemplary means for exerting the necessary vertical tension on the door, at least in the closed position, is a system wherein the side frame inserts of the bottom bar are latched in position when the door is in the closed position. In the case of the powered roll-up door, the motor is then reversed to exert the necessary vertical tension of the door to hold it taut.

While the variety of methods just described for providing wind retention are generally effective for that purpose they are not without their own disadvantages. For example, obstacles in the path of travel of the bottom bar may be problematic. If an obstacle is in place in this position, and the door continues its downward movement, damage to either the door or the object could occur. Further, if the obstacle should be warehouse or other personnel, either damage to the door or injury to the personnel could result. To avoid this problem, doors employing bottom bars typically also include some type of sensing mechanism for determining when an obstacle has been encountered. These sensors are coupled to the motor which drives the roller, and cause the door to be reversed upon encountering an obstacle.

Since this type of door is often used in a warehouse environment, where forklifts are employed, roll-up doors are also subject to being struck by such forklifts, thus putting an unwanted horizontal or other impact force on the door. Of course, other sources of such forces besides forklifts may also be encountered. Typically, such impacts on the door occur while the door is in the middle of its range of travel. A simple rigid bottom bar with side frame members extending beyond the edge of the door and into side frames, will be subject to damage upon impact. That is, it could either be bent or broken, in either event probably requiring replacement. Alternatively, if the bottom bar is rigid enough, damage to the object striking it may occur. To avoid this problem, many bottom bars include a breakaway mechanism, that allow the bottom bar attached to the bottom of the door to be separated from the side frame inserts upon application of a horizontal force above a certain magnitude. Examples of such breakaway mechanisms are found in the following U.S. Pat. Nos. 5,271,448 and 5,025,847. Since the side frame inserts typically become separated from the bottom bar in these breakaway mechanisms, they must be reassembled after a breakaway condition occurs. In the case where the side frame inserts are attached to belts the other end of which is attached to the roller, such reattachment can be problematic since the elasticity of the belts must be overcome to re-place the side frame inserts adjacent to the bottom bar. Further, regardless of whether the side frame inserts are attached to belting, the breakaway condition may be dangerous since the side frame inserts can fall by gravity and potentially injure personnel below. Thus while the presence of a breakaway mechanism can avoid the need to replace the bottom bar upon each impact, employment of such a breakaway mechanism is not without its own disadvantages. Further, such breakaway mechanisms typically allow for breakaway only upon application of a horizontal force perpendicular to the plane of the door. Provision is typically not made for breakaway due to either a vertical force or forces having both horizontal and vertical components, and such doors still require a sensor or other means, described above, for preventing impact with obstacles in the doorway.

SUMMARY OF THE INVENTION

It is thus a general aim of the invention to improve on breakaway side frame inserts as compared to those that have been used heretofore.

In accordance with that aim, it is a primary object of the invention to provide an omni-directional breakaway guide assembly, which breaks away not only for horizontally applied forces but also those applied vertically and in other directions.

It is a further object of the invention to provide a breakaway guide assembly that can be adjusted to provide a breakaway function for different environments of use.

It is a further object of the invention to provide a breakaway guide assembly that is simple to implement, and does not require a replacement of parts upon breakaway.

It is also an object of the invention to provide a breakaway guide assembly that has enhanced safety features.

It is a related object to provide a breakaway guide assembly where free fall of detached components of the assembly is prevented.

Other objects and advantages of the invention will become apparent from the description to follow.

In accordance with these and other objects, there is provided an omni-directional breakaway guide assembly for use in conjunction with an edge member extending across the leading edge of a roll-up door. The leading edge member may be rigid, semi-rigid or flexible. The omni-directional breakaway guide assembly is comprised primarily of a guide extension for engaging guide members disposed laterally with respect to the door to guide the door in a plane during travel, and an edge member portion coupled to the edge member. The breakaway guide assembly includes a magnetic coupling between the guide extension and the edge member portion, illustratively in the form of a coupling magnet fixed to the guide extension, and a magnetic cup assembly forming part of the edge member portion. The magnetic cup assembly includes a ferrous member at least against the wall closest to the edge member. The remainder of the magnetic cup assembly may be non-ferrous, and may illustratively partially surround the coupling magnet fixed to the guide extension. The magnetic attraction between the coupling magnet and the ferrous member in the magnetic cup assembly releasably attaches the guide extension to the edge member portion, and thus to the edge member. Upon application of a sufficient force on the edge member, however, this magnetic attachment is overcome and the edge member and attached edge member portion break away from the guide extension. Due to the nature of the magnetic coupling between the coupling magnet and the ferrous member in the magnetic cup assembly, such breakaway may occur for forces applied in a variety of directions to the member.

According to a preferred embodiment of the invention, the guide assembly is a side frame insert in the form of a trolley including roller wheels which engage in a vertically disposed guide track in the vertically extending guide member, or side frame. A first c-shaped bracket is attached to the side frame insert outside of the side frame. A second, oppositely-facing c-shaped bracket is received within the first c-shaped bracket, and is fixedly coupled to the coupling magnet. A hinge pin is connected between the first and second c-shaped brackets, to allow the coupling magnet to pivot relative to the trolley. As a result, upon application of a horizontal breakaway force on the bottom or edge member, some pivoting of the coupling magnet relative to the side frame insert will occur prior to the breakaway condition.

According to a further preferred embodiment of the invention, a hinge spring is disposed around the hinge pin, and serves to apply a rotational force to the coupling magnet, especially following breakaway. This rotational spring force is overcome when the coupling magnet is attached to the bottom member through the magnetic cup assembly. Upon breakaway, however, the rotational force is exerted on the coupling magnet causing it to swing toward and engage one of the side frames. If the side frame is made of a ferrous material, this magnetic engagement between the coupling magnet and the side frame will hold the side frame insert in place vertically. In the event a non-ferrous side frame is used, the coupling magnet may be advantageously provided with a high friction strip in the area of the coupling magnet where it engages the side frame. This, similarly, will cause the side frame insert to be retained in its vertical position upon breakaway. Such a feature is highly advantageous from a safety perspective, since the broken-away side frame insert will not be allowed to freely fall after breakaway.

DETAILED DESCRIPTION OF THE PREFERRED EMBODIMENTS

While the invention will be described in connection with certain preferred embodiments, there is no intent to limit it to those embodiments. On the contrary, the intent is to cover all alternatives, modifications and equivalents included within the spirit and scope of the invention as defined by the appended claims.

Figure 1:
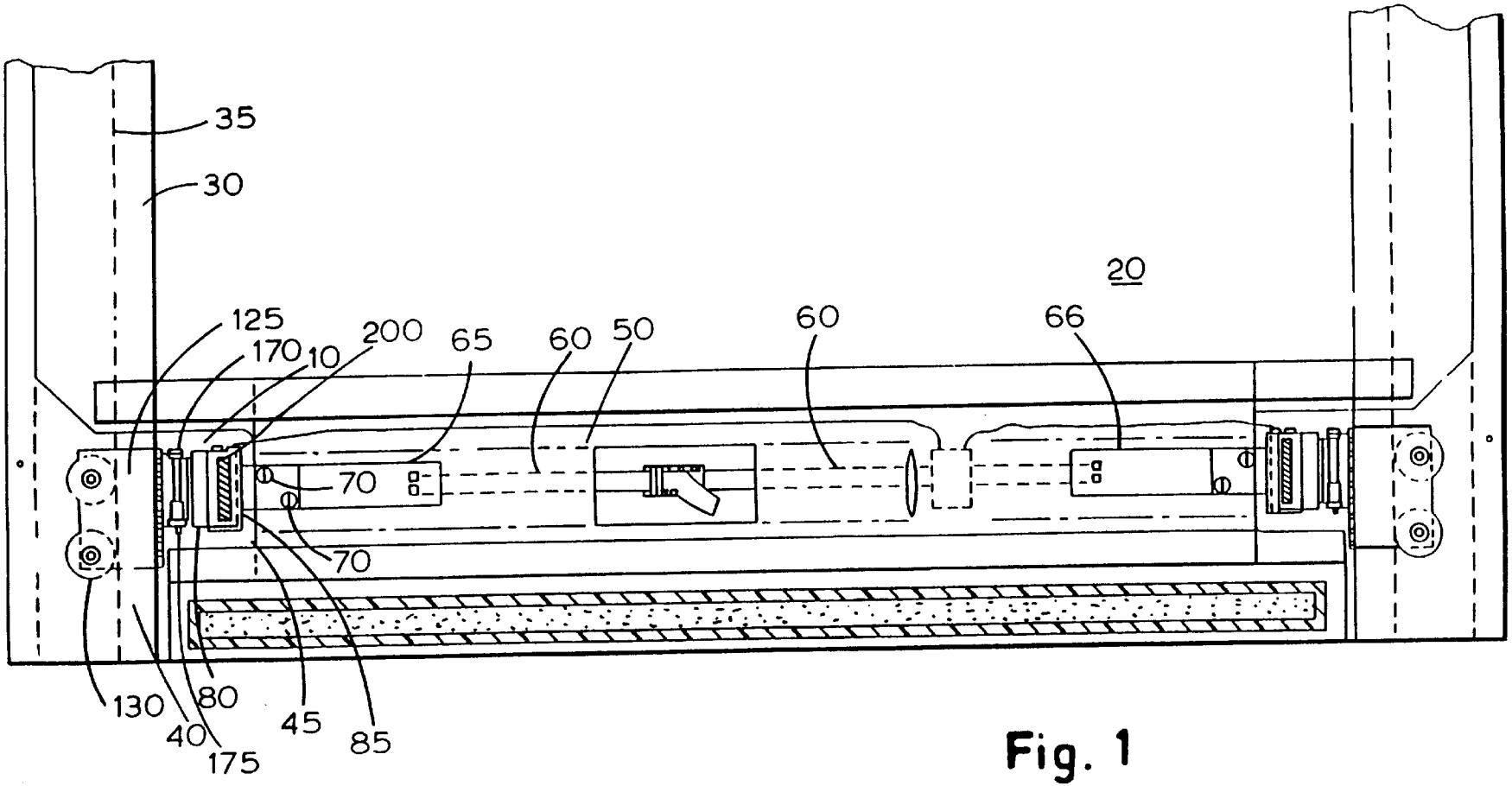
FIG. 1 is an elevational view of the leading edge of a roll-up door including an omni-directional breakaway guide assembly according to one embodiment of the invention, shown in combination with an adjustable soft bottom member.
Figure 4:
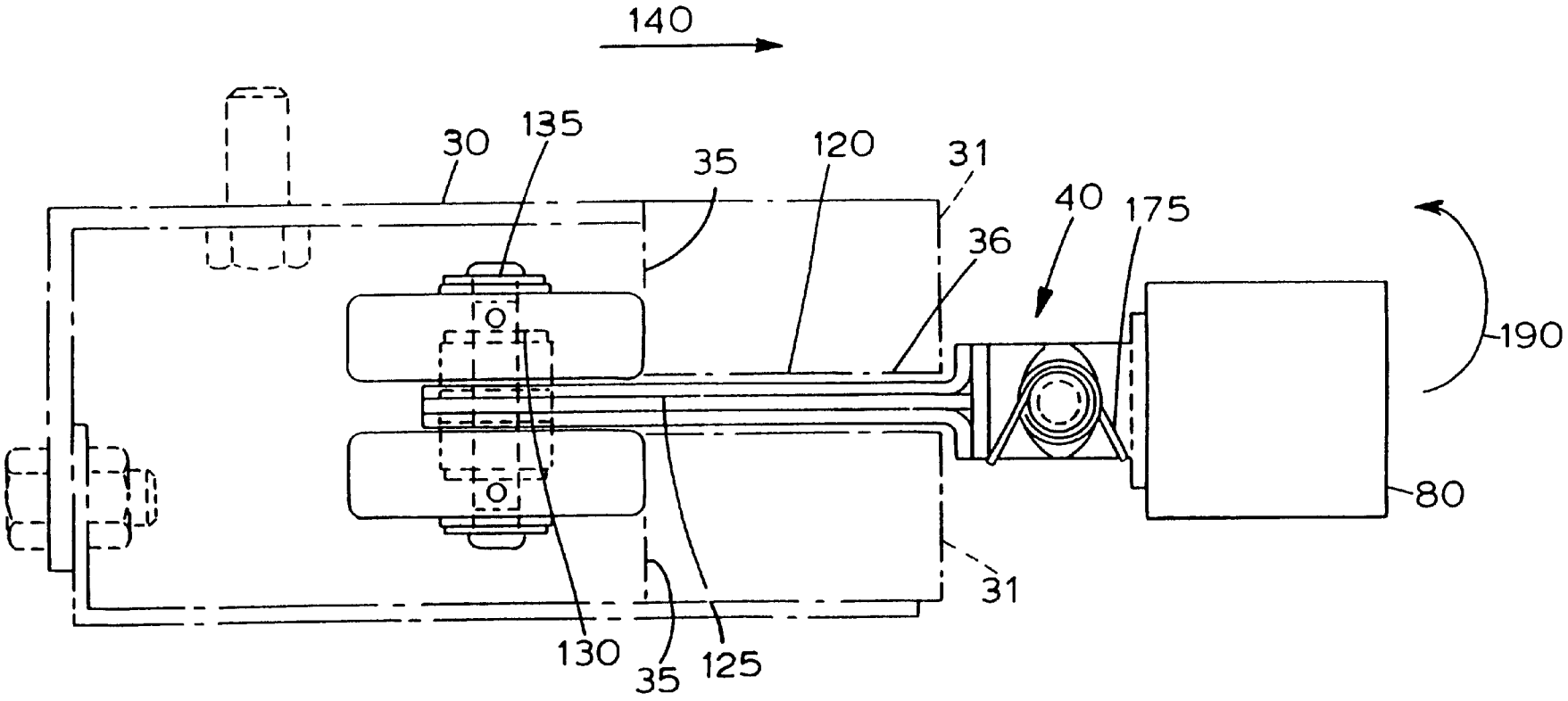
FIG. 4 is a top view of the guide extension according to an embodiment of the invention.

Turning now to the figures, FIG. 1 shows an elevational view of an omnidirectional breakaway guide assembly according to one embodiment of the invention. As the breakaway guide assembly according to the invention would have the same implementation on either side of the door, reference will only be made to the assembly shown on the left hand side of FIG. 1, for ease of reference. The breakaway guide assembly according to the invention is designated generally by reference numeral 10. Breakaway guide assembly 10 is disposed between the leading edge 20 of a conventional roll-up door curtain and a guide member in the form of a side frame 30. Since the door of this embodiment is vertically operated, the guide members extend vertically. However, for a horizontally operated door, the guide members would extend horizontally along the lateral edges of the curtain. As is true in many conventional roller door installations, the side frame 30, along with a matching side frame on the other side of the door, supports the roller upon which the door curtain is wound and unwound. In this embodiment, side frame 30 is formed with a vertically extending track in the form of a gap 36, seen in FIG. 4. The gap 36 receives a generally planar member or plate 125 forming a part of the breakaway guide assembly. The plate 125 engages the gap 36 to guide the door in a vertical plane during travel. While the present embodiment is thus limited to a so-called "side frame insert" received within a channel in the side frame, the scope of the invention is not so limited. Rather, the invention covers other forms of guide members 30 and guide extensions 40 guidingly engaging those guide members, as discussed in greater detail below. According to a preferred embodiment of the invention, the breakaway side frame insert 10 is also used in combination with a side frame 30 having a vertically extending, horizontally disposed projection shown in broken lines in FIG. 1 at 35, to also be discussed in greater detail below.

While the invention will generally be described in terms of a vertically operating door, the invention is not so limited. Rather, the invention may also be used with horizontally operating doors. Thus, while terms descriptive of this embodiment of the invention may be used (such as bottom, vertical, horizontal) they should not be considered as limiting the invention to those embodiments. The invention could be used on a roller door in which the roller is mounted vertically beside the door. Accordingly, the "leading edge" of the door need not be the bottom edge, and the "bottom member" referred to herein may be more generally considered as an "edge member." In a side mount situation, of course, the sideframes would not be vertically disposed, but rather horizontally disposed to receive and guide the guide extensions in a plane of travel of the door, typically the plane of the doorway. In either event, the sideframes are located laterally beyond the doorway.

Breakaway side frame insert assembly 10 is divided generally into a guide extension 40 and an edge member portion, which in this embodiment is a bottom member portion 45. According to this embodiment, the guide extension 40 is received within the side frame 30, in a vertically extending channel which prevents movement of the guide extension 40 into and out of the plane of the doorway, defined by the plane of the page in FIG. 1. As mentioned, however, other specific structures of vertically extending guide member (side frame) and guide extension could be used to provide the same guiding engagement between these two members. The bottom member portion 45 of breakaway guide assembly 10 is coupled to a bottom member 50 disposed along the leading edge of the door 20. The bottom member 50 may be rigid (such as a conventional bottom bar), semi-rigid, or flexible.

An exemplary bottom member, and the bottom member which is used with the breakaway guide assembly according to the invention in its preferred embodiment, can be found in U.S. patent application Ser. No. 08/386,743, now pending and filed concurrently with the parent to this c-I-p, and incorporated herein by reference. While the concurrently-filed application includes significant detail regarding the structure and function of the adjustable soft bottom member, a brief review of its structure and function are included herein for ease of understanding of the present invention. In one embodiment, the adjustable soft bottom member 50 is comprised primarily of a resilient strap 60 stretching along the leading edge 20 of the roller door. At either end of the door, strap 60 is received within semi-rigid end stiffeners 65, 66. Resilient strap 60 is then stretched when the guide extension 40, and bottom member portion 45 of the breakaway guide assembly on either side of the door and according to the invention, are coupled together. The resilient strap 60 thus provides rigidity across the leading edge 20 of the curtain, but is also substantially conformable and deflectable upon impact of the leading edge 20 with an obstruction during travel of the door. The bottom member portion 45 of the breakaway guide assembly 10 according to the invention is connected to the bottom member 50, for example, as by the bolts 70 shown in FIG. 1. With the bottom member portion 45 attached either to exemplary bottom member 50, or other, conventional bottom members, and with guide extension 40 guidingly engaging the side frame 30, the two halves 40, 45 are coupled together for the purpose of providing the breakaway feature.

According to one aspect of the invention, this coupling between guide extension 40 and bottom member portion 45 is achieved by means of a magnetic coupling. The magnetic coupling in such an environment is advantageous for several reasons. With two contacting surfaces held together by means of a magnetic field, that coupling is omnidirectional. That is, the magnetic field coupling will resist any force exerted on either side of the coupling which tends to move the two mating surfaces relative to each other. Thus, either a force tending to separate the two surfaces or a shear force tending to slide the two surfaces relative to each other will be resisted. Such an omni-directional coupling is useful in this environment since a variety of damaging forces may be exerted on the door. With the use of an omni-directional coupling according to the invention, undesirable results from these damaging forces can be avoided by providing for breakaway of the bottom member from the guide extension. Magnetic coupling is also advantageous as it is easily adjustable to differing environments. As will be discussed in greater detail below, the preferred embodiment for the magnetic coupling according to the invention is a coupling magnet and a ferrous member. A ferrous member is used herein to refer to a member comprised of material exhibiting ferromagnetic and/or electromagnetic properties. The coupling strength between these two elements can be modified by either changing the magnetic strength of the coupling magnet, changing the ferrous content of the ferrous member, or making the ferrous member a magnet itself. By simply substituting components having different magnetic properties, the magnitude of the breakaway forces which will be sustained prior to the inventive breakaway side frame assembly breaking away, can be easily adjusted. Moreover, adjustment of the magnetic coupling can be achieved by making either or both of the coupling magnet and the ferrous member an electromagnet, and adjusting the applied current.

Figure 3:
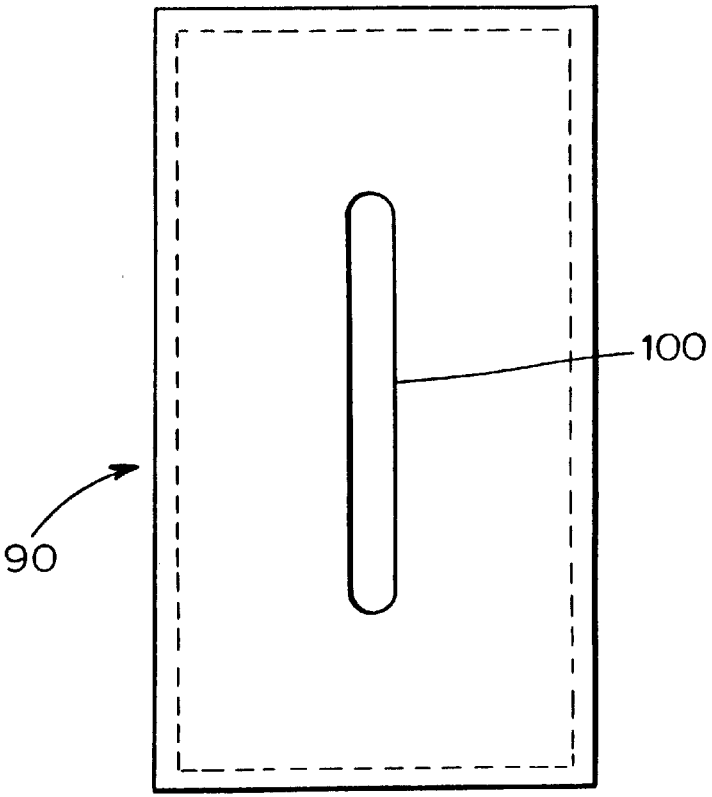
FIG. 3 is a rear elevational view of a magnetic cup assembly according to an embodiment of the invention.
Figure 2:
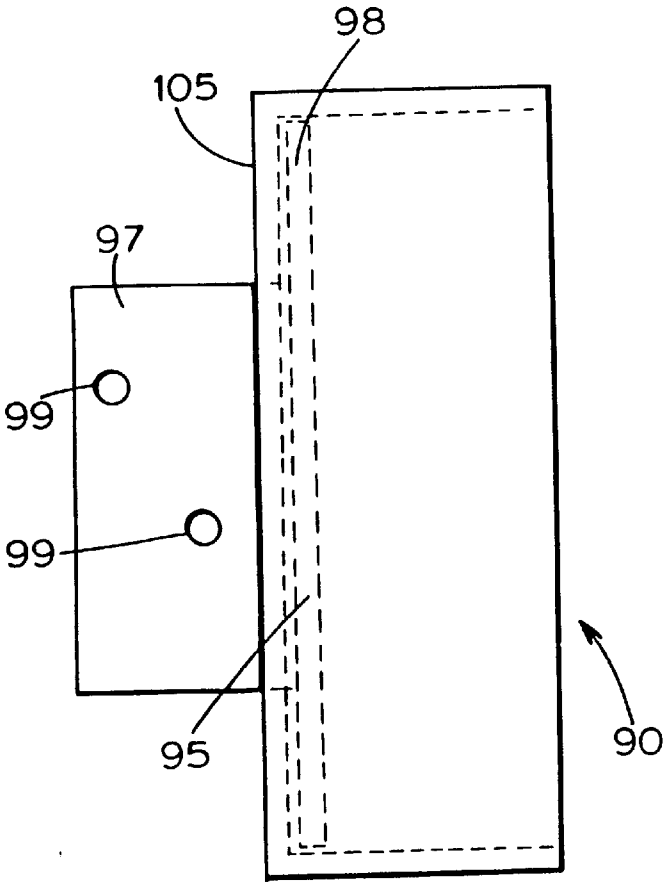
FIG. 2 is a side sectional view of the magnetic cup assembly according to an embodiment of the invention.

According to the present embodiment, this magnetic coupling is achieved by means of a coupling magnet 80 fixed to the guide extension 40, and a magnetic cup assembly 85 which forms a part of the bottom member portion 45. Coupling magnet 80 and magnetic cup assembly 85 are shown in their coupled position in FIG. 1. Magnetic cup assembly 85 is comprised of two elements, a plastic cup 90 shown in a side sectional view in FIG. 2 and a rear elevational view in FIG. 3, and an illustratively T-shaped ferrous member 95, also shown in the sectional view of FIG. 2. Cup 90 includes a slot 100 in its rear face 105. By "rear" face, it is meant that face of the cup 90 which is closest to the bottom bar 50 (see FIG. 1). Slot 100 is dimensioned to receive a tab 97 forming a part of T-shaped ferrous member 95. The other part comprising T-shaped ferrous member 95 is a ferrous plate 98. As can be seen from FIG. 3, the ferrous plate 98 is adapted to abut the rear wall of cup 90, and tab 97 extends past the rear of the cup, toward the bottom member 50. Tab 97 preferably includes mounting holes 99 for fixing T-shaped ferrous member 95 to the bottom member 50 with bolts 70. According to the preferred embodiment, the ferrous plate 98 is adhesively fixed to the rear wall 105 of the cup 90. It will be appreciated that this embodiment of the bottom member portion 45 is exemplary and not restrictive. Other embodiments are possible, and would require only a ferrous member and some means for coupling the ferrous member to the bottom member. Moreover, it should be noted that, although the present embodiment includes a coupling magnet on the guide extension and a ferrous member on the bottom member portion, the invention is not so limited. Rather, the invention covers a magnetic coupling between the guide extension and bottom member portion, regardless of the location of the magnets and/or ferrous members.

Returning to the preferred embodiment, to attach the guide extension 40 to the bottom member portion 45, coupling magnet 80 is preferably received within the cup 90 of the magnetic cup assembly 85, as seen in FIG. 1. The side walls of the cup 90 assist in aligning coupling magnet 80 with the ferrous plate 98 of the ferrous member 95. According to the present embodiment, the walls of cup 90 also serve to prevent movement of coupling magnet 80 relative to the ferrous plate 98 in the plane of the contact surface between those two members. Such a constraint on the range of motion of the coupling magnet 80 relative to the ferrous plate 98 could limit the breakaway capabilities of a breakaway guide extension assembly designed in this manner. According to the present embodiment, however, such a design was preferred, since other means, to be described below, were used to overcome this potential drawback, and give the assembly enhanced breakaway performance.

Returning to FIG. 1, it can be seen that the coupling magnet 80 forms a part of the guide extension 40 to now be described in greater detail. According to this embodiment, the portion of the guide extension 40 received within side frame 30 is in the form of a trolley assembly 120 shown in top view in FIG. 4. Trolley assembly 120 includes a trolley plate 125 and at least two trolley wheels 130. According to the preferred embodiment, four trolley wheels are provided as seen in reference to FIGS. 4 and 5. A pair of trolley wheels 130 are each mounted on spindles 135. The top view of FIG. 4 also shows a sectional view of the side frame 30. The side frame 30 is of a conventional design, including two vertically disposed members 31 including horizontal projections or inner faces 35. A gap 36 is formed between the two vertically disposed members, and is sized to receive the trolley plate 125. Trolley wheels 130 are placed on trolley plate 125 such that they engage the projections 35 to prevent trolley assembly 120 from being pulled in a direction toward the center of the curtain and out of the side frame as indicated by the arrow 140 in FIG. 4. Thus, according to this embodiment trolley assembly 120 is restrained against movement toward the center of the curtain by the engagement of trolley wheels 130 with the sideframe projection 35. While the trolley assembly just described is a preferred embodiment of the invention, it is only a representative example. If the breakaway side frame insert mechanism is used with an adjustable soft bottom member as in concurrently filed application Ser. No. 08/386,743, now pending, a restricted insert member like trolley 120 is used. However, for the general case of a rigid bottom bar, the guide extension 40 may or may not be so restrained, and only needs a surface for guidingly engaging the side frame for guided planar movement.

Figure 6:
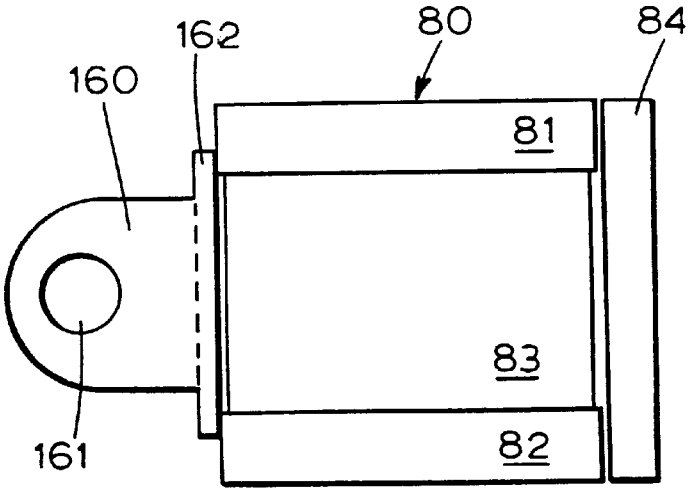
FIG. 6 is a top view showing a portion of the hinge and coupling magnet according to one embodiment of the invention.
Figure 5:
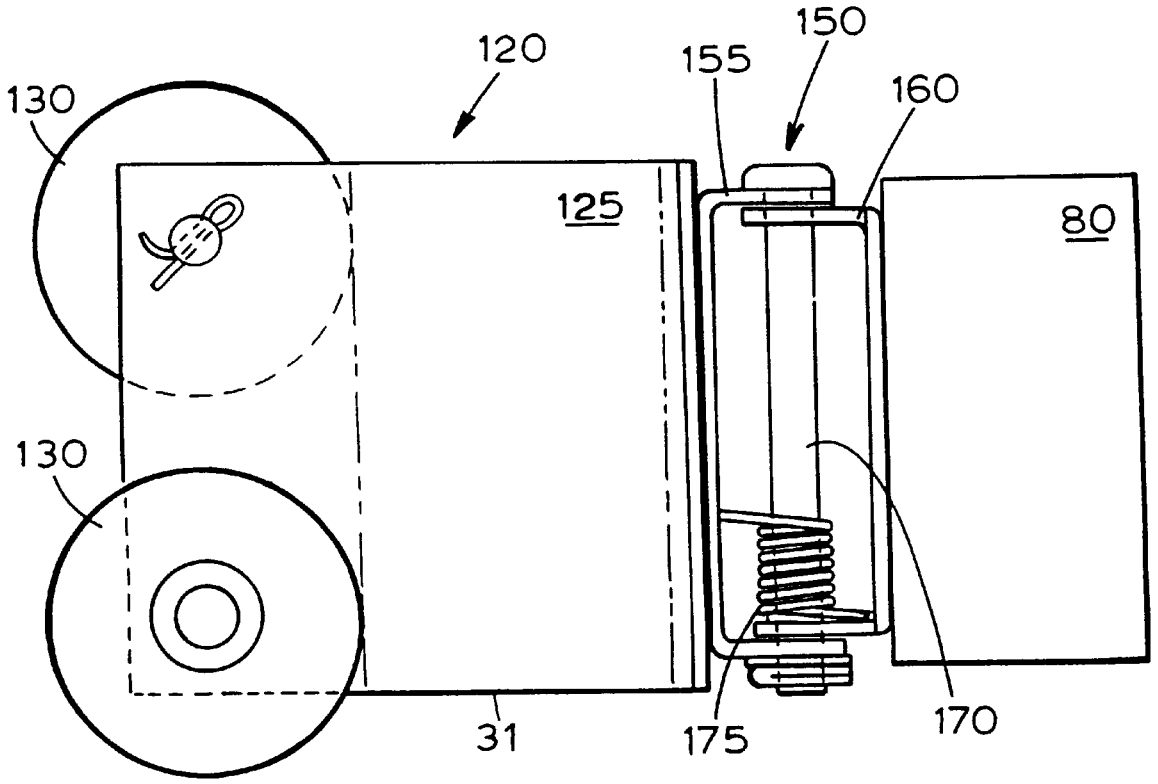
FIG. 5 is a side sectional view of the guide extension of FIG. 4.

Turning to the side view of the guide extension 40 of FIG. 5, the preferred coupling between trolley assembly 120 and coupling magnet 80 is shown. That preferred coupling is in the form of a hinge 150 formed by a first c-shaped member 155 and second c-shaped member 160, coupled together by a hinge pin 170. FIG. 6 shows the second c-shaped member 160 as attached to the coupling magnet 80. As can be seen from that figure, the top end of the second c-shaped member is roughly semi-circular in shape and includes a central hole 161 for receiving hinge pin 170. It also includes a rear plate 162 which is coupled to the coupling magnet assembly 80. In the present embodiment, coupling magnet 80 is in the form of two steel plates 81 and 82. A stainless steel cup 83 is welded between plates 81 and 82, with an opening facing towards the bottom bar. Magnets are disposed within the cup 83 and a plate 84 is welded across the opening. Of course, several other potential embodiments of coupling magnet assembly 80 are possible.

Returning to FIG. 5, it will be seen that a hinge spring 175 is disposed over hinge pin 170, and engages first and second c-shaped members 155, 160 (see FIG. 5). The function of hinge spring 175 will be discussed in greater detail below. Further, having described the structural details of the breakaway guide assembly according to this embodiment of the invention, its function will now be described in greater detail.

For the purposes of this description, two types of potentially damaging external forces which may be applied to a roll-up door will be described. The first is a force caused by an exterior object striking the door. In the typical case of use of the roll-up door in a warehouse environment, that external object will most likely be a forklift. Typically, roll-up doors in that environment include some type of sensor or treadle in the floor in front of the door which causes the door to open when activated by passage of a forklift. If the forklift is traveling in excess of the speed under which it must be traveling to allow the door to move out of the way before arrival of the forklift, or if the sensor or treadle is malfunctioning, the forklift may make contact with the roll-up door. Accordingly, the typical contact between the forklift and the door would be while the door is in the midst of its range of travel, typically upward. If the sensor or treadle is malfunctioning completely, contact between the forklift and the door may occur while the door is in the closed position. Of course, contact between the door and the forklift is not expected in the fully raised position of the door. Furthermore, other external objects besides forklifts may contact the door.

In the case of the external force such as that exerted by a forklift, which is in a generally horizontal direction the breakaway guide assembly 10 according to the invention will breakaway if that external force is above a predetermined magnitude. The breakaway sequence in regard to the application of a horizontal force is the same regardless of whether a rigid, conventional bottom bar is used, or whether an adjustable soft bottom bar as disclosed in U.S. patent application Ser. No. 08/386,743, now pending and filed concurrently with the parent to this c-I-p, is used. In either case, the bottom member 50 initially begins moving in a horizontal direction upon application of the external force. As mentioned above, however, the vertical side walls of the cup 90 comprising a part of magnetic cup assembly 85 initially prevent the coupling magnet 80 from moving in the same direction. Instead, because of the presence of the hinge 150 in place between the trolley assembly 120 and coupling magnet 80, the coupling magnet initially pivots about the hinge pin 170 and traces out an arc such that the mating faces of the coupling magnet 80 and the ferrous plate 98 maintain engagement during this first portion of the horizontal motion of the bottom member 50. As that bottom member motion continues, however, that rotational motion will reach its outer limit and a component of the horizontal force perpendicular to the mating faces of the coupling magnet 80 and the ferrous plate 98 will overcome the magnetic coupling between those two members, thus causing the bottom member portion 45 and the guide extension 40 of the breakaway guide assembly 10 to separate, and thus "breakaway".

The breakaway sequence for a horizontal force just described is advantageous in the environment in which the door will be used. The side walls of the magnetic cup assembly 85 and the presence of the hinge assembly 150 according to this preferred embodiment allow the door to move horizontally a limited amount before any pulling force tending to separate coupling magnet 80 and ferrous plate 98 is encountered. As a result, for a horizontal force applied over a small distance, the bottom member would be allowed to move a limited amount without the door breaking away. This could be the case even if a very small magnetic force held coupling magnet 80 and ferrous plate 98 together since a force tending to separate magnet 80 and plate 98 may not even be exerted on these two members if the range of travel of the door caused by the horizontal force is small enough. It should also be noted that this advantageous function is illustratively provided by the hinge assembly 150 allowing pivotal movement, and by the magnetic cup assembly 85 initially engaging the sides of the coupling magnet 80. One skilled in the art will appreciate that this function could be achieved by alternative structure. For example, the pivotal movement need not be provided by a hinge, but could be provided by a resilient member connecting the coupling magnet and the trolley. Moreover, the pivotal movement may be provided on the bottom member portion as opposed to the guide extension. Finally, a strictly "pivotal" movement is not required, and a bending or other relative displacement could achieve the same function. It should also be noted that this breakaway guide mechanism 10 will break away from impacts on either side of the door. The gap 36 engaging both sides of the trolley plate 125 restrains the guide extension 40 in both of the horizontal directions perpendicular to the door. Of course, other guiding engagements between the guide extension 40 and vertically extending guide members 30 could provide such breakaway, or breakaway only in one of these directions.

The breakaway guide assembly 10 according to the invention also advantageously provides a breakaway function for forces applied in the plane of the door. An example of such a force would be that exerted on the door by contact between a descending door and an obstruction placed in the doorway. In the preferred embodiment, wherein the breakaway guide assembly 10 is coupled to an adjustable soft bottom member as disclosed in concurrently filed U.S. patent application Ser. No. 08/386,743, now pending, breakaway for this condition would occur. If the breakaway guide assembly 10 were modified within the scope of the present invention, breakaway for a rigid bottom bar for the same condition would also be possible.

For the first case of the use of breakaway guide assembly 10 with an adjustable soft bottom member 50 as in the concurrently-filed application, it will be appreciated that the soft bottom member 50 will illustratively deform upwardly in the area of the obstruction that it encounters during its downward travel. As a result, the portions of the door on either side of the contact between the door and the obstruction will assume an upward angle toward the point of contact. Continued travel of the door downward will cause a pulling/separating force to be exerted on the ferrous member 98 relative to the coupling magnet 80, since the coupling magnet 80 will maintain its horizontal orientation. The top and bottom walls of the magnetic cup assembly 85 may initially maintain the coupling magnet face and the face of the ferrous member 98 in engagement, but the separating force will eventually overcome the magnetic attraction between these two members, thus resulting in breakaway. Use of the magnetic breakaway side frame insert assembly according to the invention will also provide breakaway for a force applied in the plane of the door if a conventional, rigid bottom bar is used. In that case, the magnetic cup assembly 85 could illustratively be modified to either remove or reduce the length of the top and bottom walls of the cup. Accordingly, upon application of the force in the plane of the door, the faces of the coupling magnet 80 and ferrous member 98, assuming that the force overcomes their magnetic attraction, could slide relative to each other in a generally vertical plane, until breakaway occurs.

To add enhanced safety to the operation of the door, and to prevent injury or other accidents from occurring upon breakaway, the hinge assembly 150 may have an additional advantageous function. In present doors, a breakaway condition is potentially hazardous because the broken-away side frame inserts may fall to the ground. This occurs by virtue of gravity, and, in the case of side frame inserts coupled to the roller by means of tensioning straps, the gravitational force is potentially enhanced by an elastic restoring force from the tensioning straps pulling on the side frame inserts. This hazard is prevented according to the present invention by means of the guide extension 40 of the breakaway guide assembly 10 including a mechanism for locking the insert half to the side frame 30 upon breakaway. In the present embodiment, the hinge assembly 150 allows this function. Upon breakaway occurring, coupling magnet 80 and the attached second c-shaped member 160 are rotated under the action of the hinge spring 175 (see FIG. 4). The rotation is in the sense of the arrow 190. Hinge spring 175 causes rotation of the coupling magnet 80 until the magnet engages the side frame 30. Assuming the side frame 30 is made of a ferrous material, this contact between coupling magnet 80 and side frame 30 will hold the guide extension 40 in place vertically along the side frame, thus preventing it from falling from the floor and potentially injuring warehouse personnel. In the alternative, the side frame 30 may be made of a non-ferrous material such as aluminum. In that event, a high-friction material may be fixed to the side walls of the coupling magnet 80. This strip of high-friction material is labeled 200 in FIG. 1. Again, as hinge spring 175 rotates coupling magnet 80 about hinge pin 170, the coupling magnet 80 and high-friction strip 200 will engage the side frame 30. The friction between strip 200 and side frame 30 will be sufficient to maintain guide extension 40 in its vertical position along the side frame, again preventing potential injury to personnel in the vicinity. One skilled in the art will appreciate that other means beside a spring-loaded hinge could be used to rotate the coupling magnet relative to the trolley plate.

Figure 7:
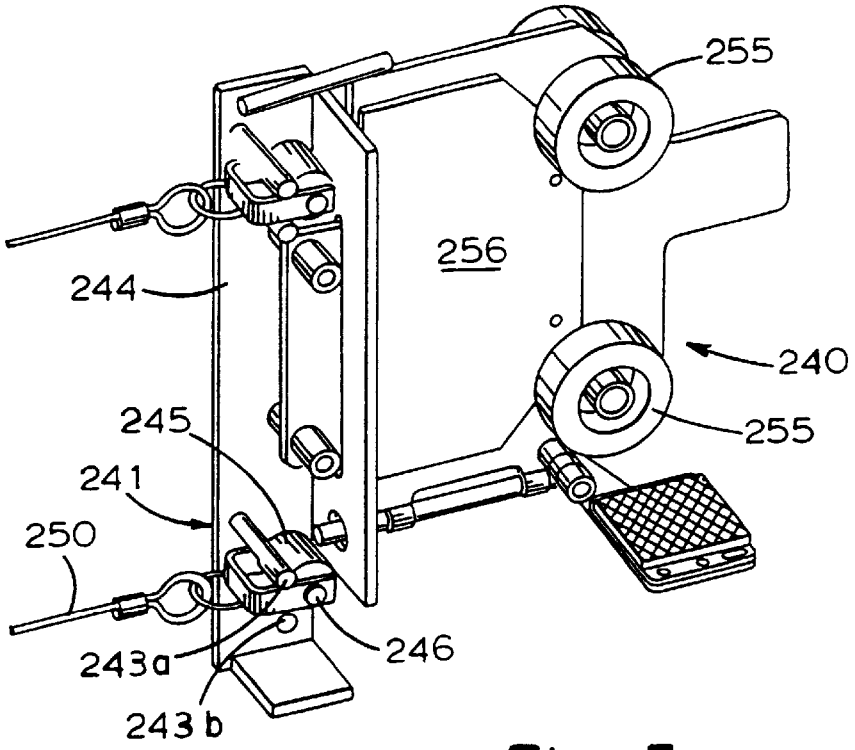
FIGS. 7–9 are isometric views of an alternative breakaway mechanism according to the invention, showing an operational sequence of breakaway.
Figure 8:
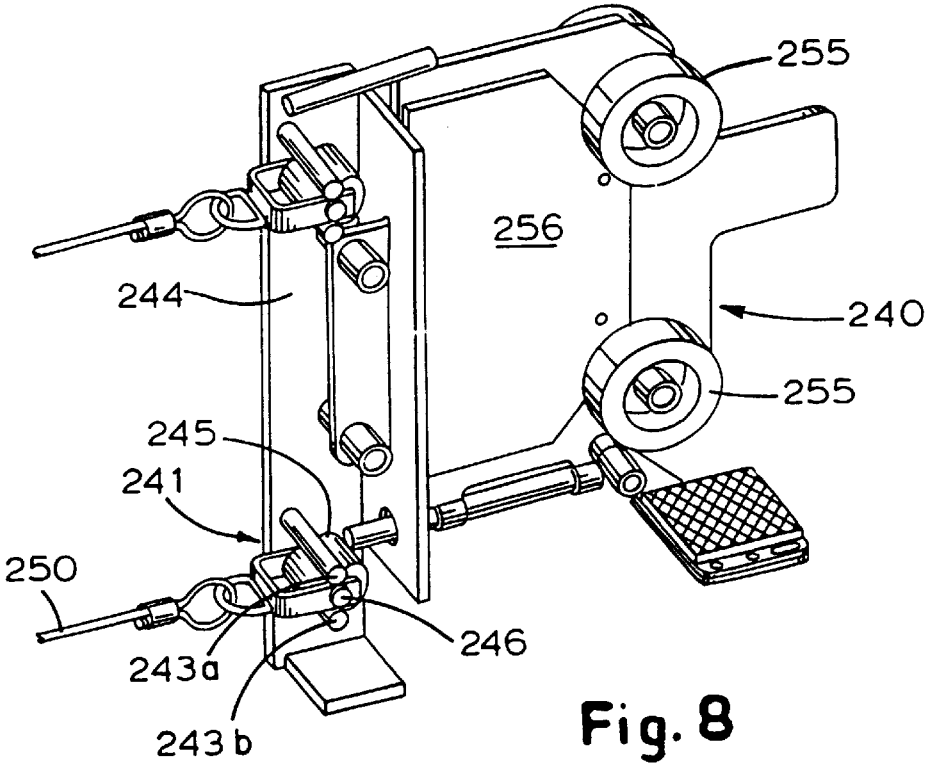
Figure 9:
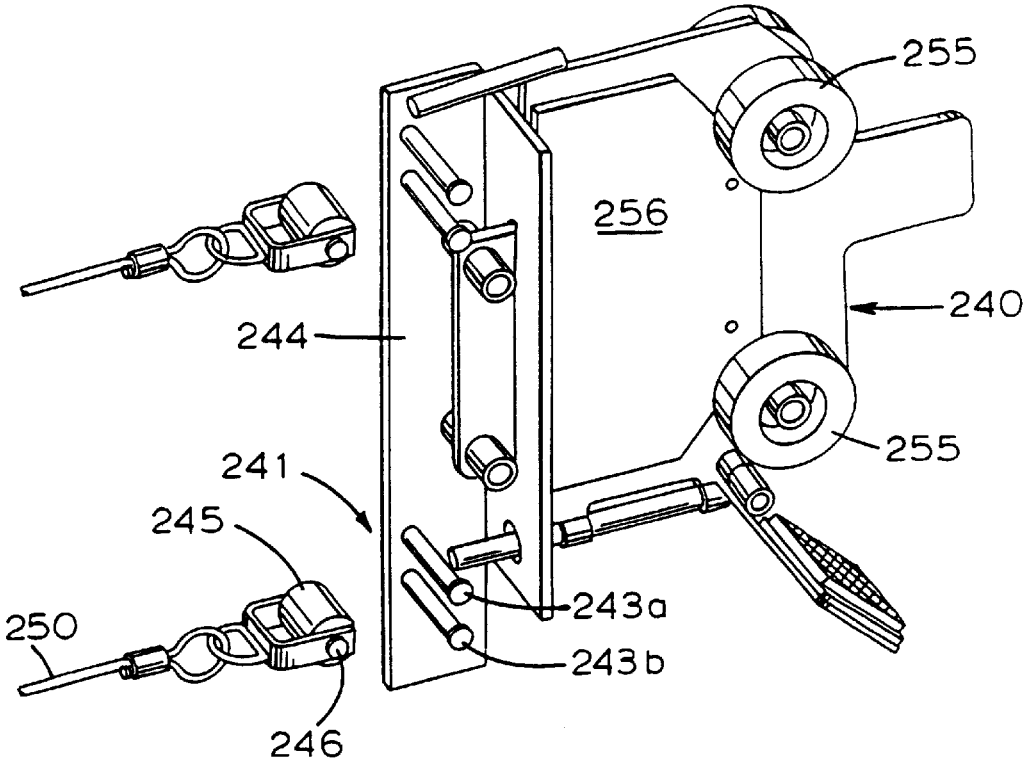

In an alternative embodiment of the invention, the releasable coupling which provides omni-directional breakaway uses deformation as opposed to magnetic force. A releasable coupling according to this aspect of the invention is shown in FIGS. 7–9. In this embodiment, the bottom member is preferably in the form of a cable 250 as opposed to a strap or belting as in the previous embodiment. As in the previous embodiment, this embodiment shows a vertically operating door, but the invention may also be used on a horizontally operating door, or other doors. Again, however, the releasable coupling may be used with a variety of bottom or edge members. It will also be noted that the present embodiment includes two cables 250. The lower cable 250 serves an additional function, not forming a part of this invention, as part of a system for detecting an impact on the door. Even so, the releasable coupling on that cable and the upper cable are the same in function and operation, although they may preferably be designed to separate for different magnitudes of impact forces on the door.

The releasable coupling according to this embodiment comprises a bottom or edge member portion 245 attached to or forming a part of the edge or bottom member 250, and a guide extension portion 241 attached to or forming a part of the guide extension. The bottom or edge member portion is in the form of a deformable roller 245 attached to the cable 250 by an axle member 246. The guide extension portion is in the form of a cage 241 comprising two axles 243*a* and 243*b* illustratively formed of rigid material such as steel, and two flatbar members 244 (one of which has been removed for clarity) forming a part of the guide extension or trolley 240. The cage 241 is designed such that the deformable roller 245 is normally received within the cage, i.e. the roller 245 is disposed behind the axles 243*a,b* as in FIG. 7. Toward that end, the separation between the axles 243*a,b* is preferably smaller than the undeformed diameter of the roller 245. When a force tending to separate the cable 250 and the trolley 240 is exerted on the cable, however, the deformable roller 245 is intended to deform and pull past the axles 243*a* and 243*b* forming the cage, as illustrated sequentially in FIGS. 7–9. The preferred material for roller 245, and that gives the desired deformability is compressed URETHANE.

As before, the source of such a force tending to separate the cable 250 from the trolley 240 is illustratively an impact on the door. The cable 250 is coupled to a trolley 240 at each end of the cable, thus stretching the cable between the trolleys. For an impact on the door in the vicinity of the cable, the impact force will either be directly applied to the cable 250, or be indirectly applied through the fabric of the curtain. In either event, an impact force above a certain magnitude will cause the cable 250 to deform in the area of the impact. For forces below the predetermined magnitude (such as might be applied to the door by wind or pressure differentials) separation of the edge member portion and the guide member portion is not desired.

For an impact into the plane of the doorway (e.g. impact by a fork truck) the cable 250 will bow inward. For an impact in the plane of the doorway (e.g. the downwardly traveling curtain encountering an obstacle), the cable 250 will bow upward. At the same time, the trolley 240 is restrained from moving in a direction toward the center of the curtain. To provide such restraint from movement toward the center of the curtain, trolley 240 illustratively includes rollers 255 disposed on either side of a body 256. These rollers, in turn, engage projections 35 on the side frame 30 as in the previous embodiment. The engagement between the rollers 255 and the projection 35 prevents the trolley 240 from moving toward the center of the curtain even when the cable 250 is deformed as described above by an impact on the curtain. Accordingly, the bowing of the cable 250, combined with the restraint of the trolley 240 exerts a force on the cable tending to separate the cable from the trolley. In response to such a force the deformable roller 245 of the releasable coupling of this aspect of the invention deforms and releases from the cage assembly on the trolley.

The releasable coupling according to this embodiment thus provides coupling of the trolley 240 and cable 250 for unimpeded operation of the door, and also provides for separation of the cable 250 and trolley 240 for impacts on the door above a certain magnitude, and which are exerted both in and into the plane of the curtain (i.e. the coupling in omni-directional). The magnitude of impact that will cause such separation may be modified in a variety of ways. For example, the composition of the deformable roller 245 could be modified, a less deformable material giving a greater resistance to separation for the same impact force. Other examples of modifications that would change the magnitude of impact required to separate the cable and the trolley for this releasable coupling will be apparent to one of skill in the art.

Figure 10:
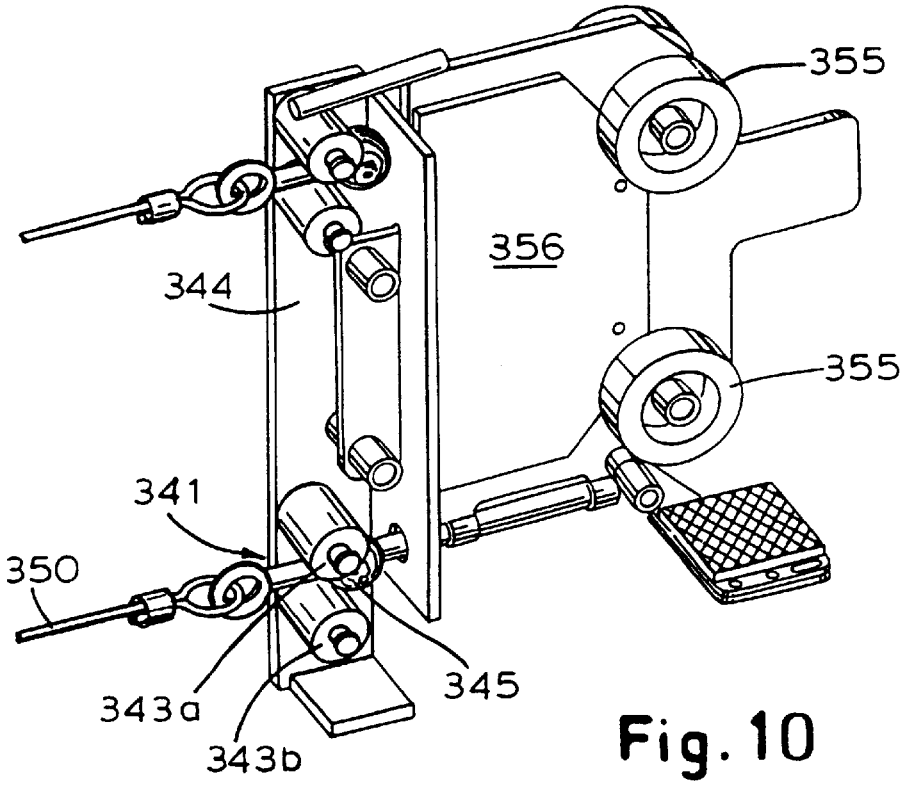
FIGS. 10–12 are isometric view of a further alternative embodiment according to the invention, showing an operational sequence of breakaway.
Figure 11:
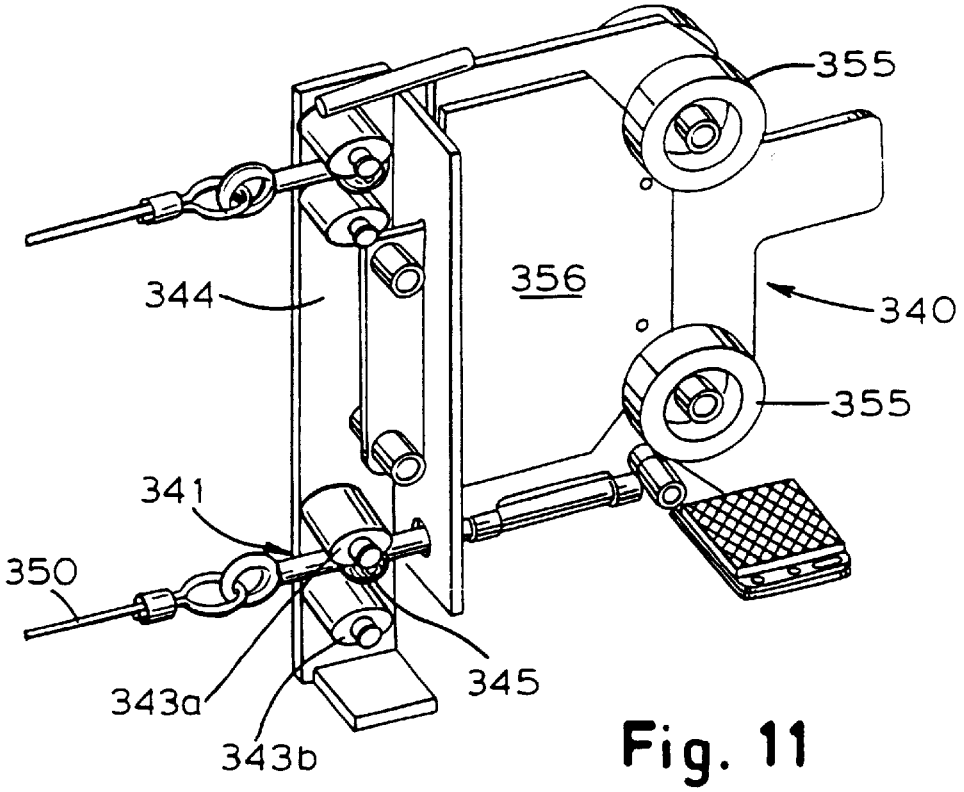
Figure 12:
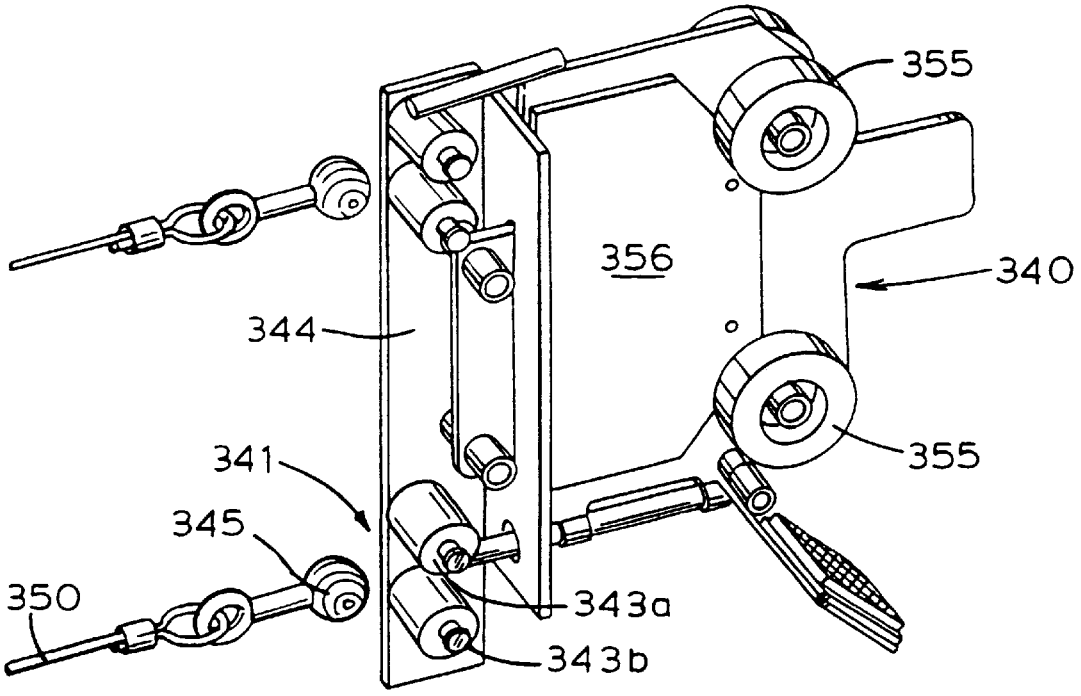

A further alternative embodiment is shown in FIGS. 10–12, which embodiment also provides for omni-directional breakaway through deformation. In this case, the edge member portion is in the form of a rigid member, illustratively a sphere 345, coupled to or cable 350. As in the second embodiment, the guide extension is in the form of a trolley 340 which illustratively includes a body 356 and rollers 355 for engaging the projections 35 of the side frame 30, while the guide extension portion is in the form of a cage 341 which is preferably formed of steel or other rigid pins around which rollers 343*a,b* are mounted. The rollers 343*a,b* are preferably formed of a deformable material, such as the URETHANE used for the deformable roller 245 in the previous embodiment. When undeformed, the surfaces of the rollers 343*a,b* are separated by a distance less than the diameter of the sphere 345. Flatbar members 344 may also comprise a portion of the cage 341. Under normal operation, the sphere 354 is disposed within the cage 341. When a force tending to separate the cable 350 and the trolley 340 is exerted on the cable, however, the sphere 345 is intended to pull past the deformable rollers 343*a* and 343*b* thus causing them to deform and allow continued passage of the sphere 345, as illustrated in the operational sequence of FIGS. 10–12. Of course, it will be appreciated that the sphere 345, while preferably rigid, could also be formed of a deformable material.

What is claimed is:

1. A releasable assembly disposed on an industrial door, the door selectively blocking and unblocking a doorway and generally defining a plane when in a blocking position, the doorway including a guide member disposed laterally on a side thereof for guiding the door between the blocking position and an unblocking position, the releasable assembly comprising:

an edge member disposable adjacent to a leading edge of the door, a guide extension engageable with the guide member of the doorway to guide the door between the blocking and unblocking positions; and a releasable coupling disposed between the guide extension and the edge member, the releasable coupling allowing omni-directional release of the guide extension and the edge member when forces above a predetermined magnitude are applied to the door in directions into and in the plane of the door, the releasable coupling comprising an edge member portion which is attachable to the edge member and a guide extension portion which is attached to the guide extension, at least one of which is deformable to allow release of the coupling and omni-directional release of the guide extension portion and the edge member portion when said forces are applied to the door;

one of the edge member portion and the guide extension portion comprising a deformable roller having an undeformed diameter, and the other of the guide extension portion and the edge member portion comprising two axles separated by a distance which is less than the undeformed diameter of the roller, the roller being disposed behind the axles when the releasable coupling is attached, and deforming to be pulled past the axles when said forces are applied to the door.

2. A releasable assembly disposed on an industrial door, the door selectively blocking and unblocking a doorway and generally defining a plane when in a blocking position, the doorway including a guide member disposed laterally on a side thereof for guiding the door between the blocking position and an unblocking position, the releasable assembly comprising:

an edge member disposable adjacent to a leading edge of the door, a guide extension engageable with the guide member of the doorway to guide the door between the blocking and unblocking positions; and a releasable coupling disposed between the guide extension and the edge member, the releasable coupling allowing omni-directional release of the guide extension and the edge member when forces above a predetermined magnitude are applied to the door in directions into and in the plane of the door, the releasable coupling comprising an edge member portion which is attachable to the edge member and a guide extension portion which is attached to the guide extension, at least one of which is deformable to allow release of the coupling and omni-directional release of the guide extension portion and the edge member portion when said forces are applied to the door, one of the edge member portion and the guide extension portion comprising a sphere having a diameter, and the other of the guide extension portion and the edge member portion comprising two axles having deformable rollers disposed thereon, the rollers being separated by a distance which is less than the diameter of the sphere when in an undeformed state, the sphere being disposed behind the rollers when the releasable coupling is attached, and the rollers deforming into a deformed state to allow the sphere to be pulled past the rollers when said forces are applied to the door.

3. The releasable assembly of claim 2, wherein the sphere is formed of deformable material.

4. The releasable assembly of claim 2, wherein the sphere is formed of rigid material.

5. The releasable assembly of claim 1, wherein the edge member comprises a cable.

6. The releasable assembly of claim 2, wherein the edge member comprises a cable.

7. A releasable assembly disposed on an industrial door, the door selectively blocking and unblocking a doorway and generally defining a plane when in a blocking position, the doorway including a guide member disposed on a side thereof for guiding the door between the blocking position and an unblocking position, the releasable assembly comprising:

an edge member disposable adjacent to a leading edge of the door, a guide extension engageable with the guide member to guide the door in a plane; and a releasable coupling between the guide extension and the edge member, the releasable coupling providing release of the guide extension and the edge member when a force above a predetermined magnitude is applied to the door in a direction substantially in the plane of the door;

the releasable coupling comprising a deformable roller having an undeformed diameter and coupled to one of the edge member and the guide extension, and two axles separated by a distance which is less than the undeformed diameter of the roller, the two axles being coupled to the other of the edge member and the guide extension, the roller being disposed behind the axles when the releasable coupling is attached, and deforming to be pulled past the axles when said forces are applied to the door.

8. A releasable assembly disposed on an industrial door, the door selectively blocking and unblocking a doorway and generally defining a plane when in a blocking position, the doorway including a guide member disposed on a side thereof for guiding the door between the blocking position and an unblocking position, the releasable assembly comprising:

an edge member disposable adjacent a leading edge of the door, a guide extension engageable with the guide member to guide the door in a plane; and a releasable coupling between the guide extension and the edge member, the releasable coupling providing release of the guide extension and the edge member when a force above a predetermined magnitude is applied to the door in a direction substantially in the plane of the door the releasable coupling comprising a sphere having a diameter and being coupled to one of the edge member and the guide extension, and two axles having deformable rollers disposed thereon, the two axles being coupled to the other of the edge member portion and the guide extension, the rollers being separated by a distance which is less than the diameter of the sphere when in an undeformed state, the sphere being disposed behind the rollers when the releasable coupling is attached, and the rollers deforming into a deformed state to allow the sphere to be pulled past the rollers when said forces are applied to the door.

* * * * *